US005452548A

United States Patent [19]

Kwon

[11] Patent Number: 5,452,548

[45] Date of Patent: Sep. 26, 1995

[54] BEARING STRUCTURE WITH ISOLATION AND ANCHOR DEVICE

[76] Inventor: Heug J. Kwon, 206 Ryerson Rd., Lincoln Park, N.J. 07035

[21] Appl. No.: 84,481

[22] Filed: Jul. 1, 1993

[51] Int. Cl.[6] ..... E02D 27/34

[52] U.S. Cl. ..... 52/167.8; 52/167.7; 248/567; 248/595

[58] Field of Search ..... 52/167 E, 167 EA, 52/167 RS, 167 RA, 167.4, 167.6, 167.7, 167.8, 167.1; 248/567, 568, 569, 570, 595

[56] References Cited

U.S. PATENT DOCUMENTS

| | | | |
|---|---|---|---|
| 4,188,681 | 2/1980 | Tada et al. | 52/167 RS |
| 4,593,502 | 6/1986 | Buckle | 52/167 E |
| 4,633,628 | 1/1987 | Mostaghel | 52/167 E |
| 4,713,917 | 12/1987 | Buckle et al. | 52/167 EA |
| 5,014,474 | 5/1991 | Fyfe et al. | 52/167 EA |
| 5,201,155 | 4/1993 | Shimoda et al. | 52/167 E |

FOREIGN PATENT DOCUMENTS

| | | | |
|---|---|---|---|
| 1029538 | 1/1989 | Japan | 52/167 E |
| 232426 | 9/1990 | Japan | 52/167 EA |
| 248551 | 10/1990 | Japan | 52/167 E |

*Primary Examiner*—Michael Safavi
*Attorney, Agent, or Firm*—Stanley J. Yavner

[57] ABSTRACT

The present invention is concerned with the improvement of bearings for use in supporting bridges or large-scale buildings. The invention comprises combining the advantages of a conventional metal bearings with synthetic rubber bearings to improve vertical resistance as well as horizontal and torsional rigidity under reciprocal seismic load. Relatively simple and inexpensive products are used to produce the invention.

The invention is formed with the multilayer pattern of having metal plates as a bearing unit and metal bars, located in the center of the bearing unit, which anchor the top and bottom bearing plates so as to limit horizontal displacement. It utilizes synthetic rubber for sealing bearing units to protect the metal bearing units from corrosion.

4 Claims, 5 Drawing Sheets

BEARING STRUCTURE WITH ISOLATION AND ANCHOR DEVICE

FIELD OF THE INVENTION

This invention relates primarily to bridge structures and more particularly to improved bearings for use in supporting bridges or large-scale buildings.

BACKGROUND OF THE INVENTION

Mechanical metal bearings that have been generally used for bridges, include metal rocker bearings and metal plate bearings which are designed to release horizontal displacement by a rolling or sliding action as well as to support a heavy vertical load on a small contact area of metal bearings. These types of bearings have two serious problems:

1. One problem is that, as time passes, corroding action at the metal contact area causes gradual loss of the rolling or sliding function of the bearing units, unless these are properly cleaned and maintained.
2. Another problem is that these conventional metal bearings are vulnerable to reciprocal seismic force because they do not have proper shock absorbing systems to release seismic impact.

Synthetic rubber bearings reinforced by metal plates have been more popular for use as bearings than mechanical metal bearings, because they do not seem to have a serious corroding problem, as mechanical metal bearings do. They are capable of absorbing seismic impact to a certain level due to the flexibility of synthetic rubber itself. However, synthetic rubber bearings have some problems which are described below:

a. They require more bearing contact area due to having a lesser bearing capacity than mechanical metal bearings.
b. They might result in shear failure by a seismic reciprocal force crossing beyond the limit of the shear rigidity of synthetic rubber.

SUMMARY OF THE INVENTION

The present invention comprises a multilayer pattern consisting of metal plates which support vertical load and resist horizontal displacement by friction between plate layers, one vertical bar which anchors top and bottom bearing plates to limit horizontal displacement due to seismic load, and synthetic rubber which covers the bearing units to protect them from corrosion. This bearing unit comprises a multilayer of metal plates, to support a heavy vertical load on a relatively smaller area than synthetic rubber bearings. It also has good tolerance for horizontal and rotational displacements. This invention has a shock absorbing system which utilizes the friction caused by the movement of the metal plates against one another.

Another noteworthy thing about this invention is that its vertical anchor bars are used in conventional synthetic rubber bearings, reinforced by multilayers of metal plates for resisting the possible shear failure of the synthetic rubber due to seismic load.

This invention is designed to mitigate the problems of the conventional bearings mentioned above. It promotes vertical and horizontal rigidity and resists corrosion.

DETAILED DESCRIPTION OF THE PREFERRED AND ALTERNATIVE EMBODIMENTS

Figure 1:
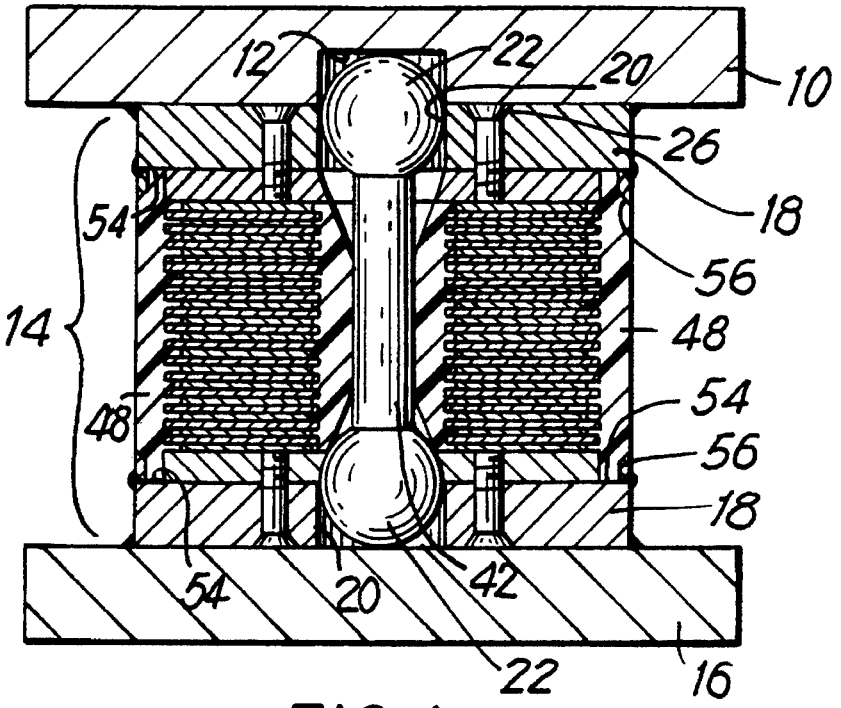
FIG. 1 is a sectional view of a metal plate anchor bearing according to the present invention.
Figure 5:
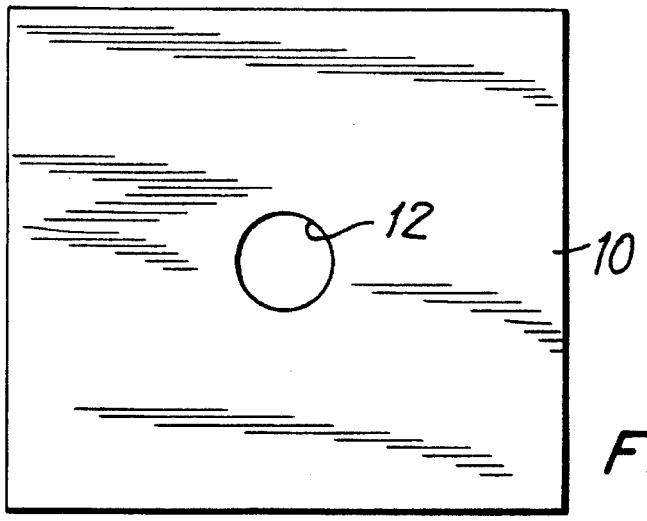
FIG. 5 is a plan view of a sole plate, which is the upper plate shown in FIG. 1 hereof.

FIG. 1 illustrates a typical component for the bearing assembly of the present invention. More specifically, sole plate 10 defines a cylindrical (or half-spherical) pocket 12 at its center, which is illustrated in plan view in FIG. 5. This structure functions to connect the superstructure to the bearing unit, generally designated 14 in FIG. 1. This transfers all the loads to bearing unit 14 through sole plate 10.

Base plate 16 functions as a seat for bearing unit 14, in order to carry all the load from bearing unit 14 to the substructure. Bearing unit 14 is connected to sole plate 10 and the base plate 16 by welding or the like, and sole plate 10 is commonly bolted or welded to the substructure.

Base plate 16 is attached to a concrete pedestal of the substructure by an anchor bolts or the like (not shown).

Figure 6:
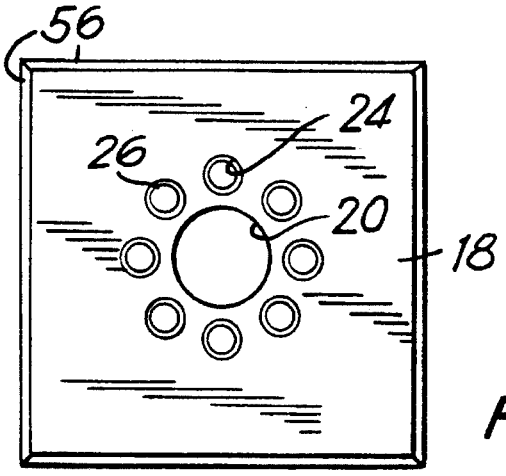
FIG. 6 is a plan view of top and bottom cover plates shown in FIG. 1.
Figure 7:
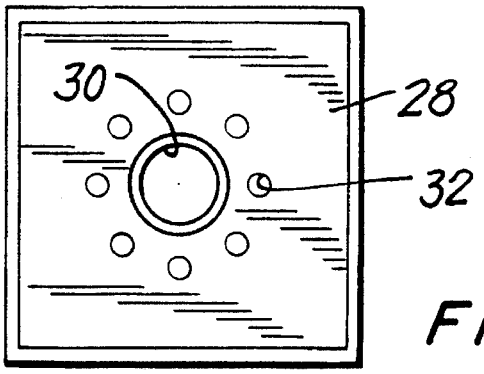
FIG. 7 is a plan view of top and bottom guide plates shown in FIG. 1.
Figure 11:
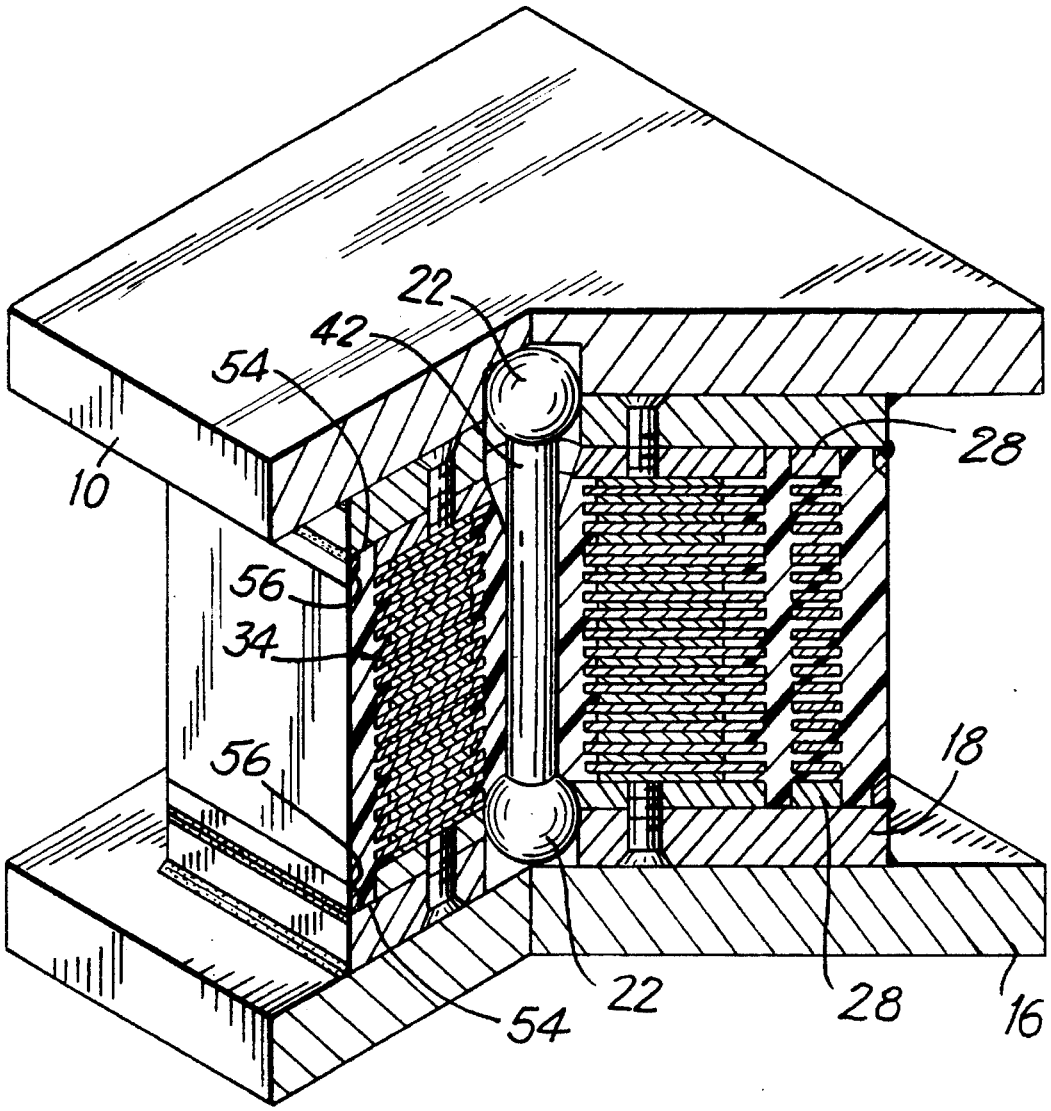
FIG. 11 is an elevational, top, left side and front isometric view, of the assembled structure according to the present invention.

FIG. 6 shows top and bottom cover plates 18 in bearing unit 14, defining a large hole 20 in its center portion, functioning as a pocket for anchor balls 22. The smaller holes 24, concentrically arranged around larger hole 20, function to hold countersunk bolts 26. Cover plates 18 are attached to top and bottom guide plates 28 (FIG. 11) by means of countersunk bolts 26. More specifically, guide plates 28 are shown in FIG. 7 as defining a large spherical hole 30 in the middle for seating anchor ball 22, as well as smaller holes 32 for countersunk bolts. Multilayered metal plates generally designated 34 (FIG. 11) are located in top and bottom guide plates 28 of FIG. 2.

Figure 2:
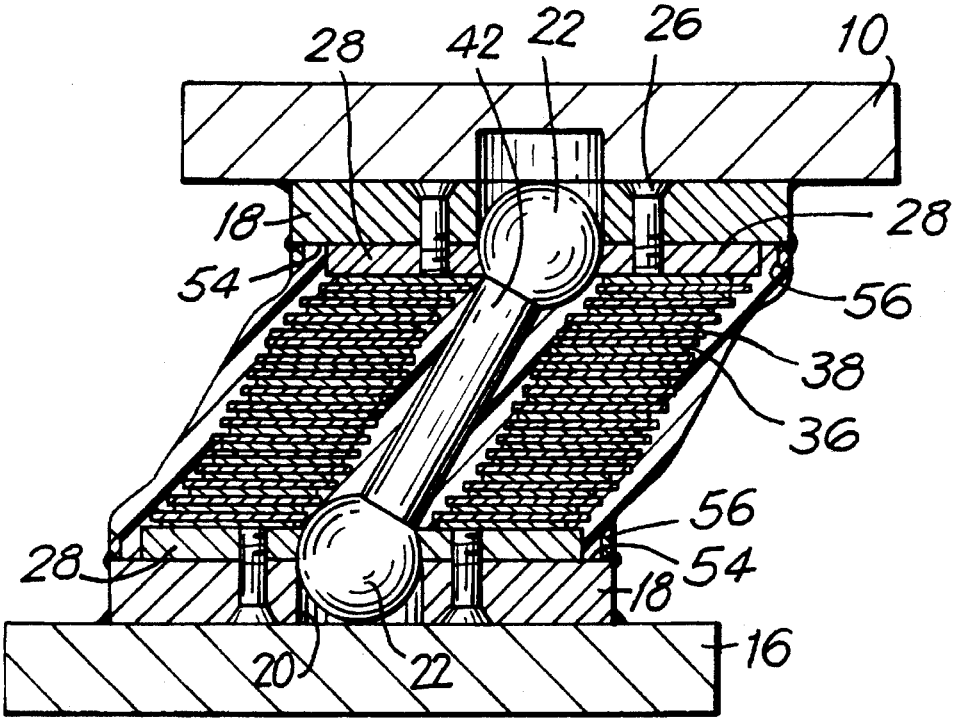
FIG. 2 is a sectional view of a metal plate anchor bearing, according to the present invention, in deformed shape due to horizontal displacement.
Figure 8:
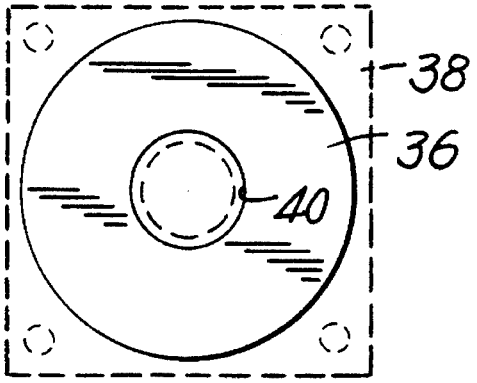
FIG. 8 is a plan view of a smaller metal plate shown in FIG. 1.

Multilayered metal plates, generally designated 34, are provided to support all of the vertical load, as well as horizontal forces transmitted to bearing unit 14. The horizontal and rotational forces are released by horizontal and rotational displacement of multilayered metal plates 34 in bearing unit 14. Metal plates 34 include alternate smaller plates 36, and larger plates 38 (FIG. 2). Smaller plates 36, as illustrated in FIG. 8, are round in shape defining a large hole 40 in the center. Round hole 40 is for the anchor bar 42 to pass through the middle of bearing unit 14.

Thus, the smaller plate 36 is made to minimize interlocking friction when bearing unit 14 is subject to rotational displacement. Larger plate 38 (FIGS. 8 and 9) also defines a center hole 44 and four small round holes 46 in the corners thereof. The larger hole 44 is for anchor bar 42 to pass therethrough.

Figure 9:
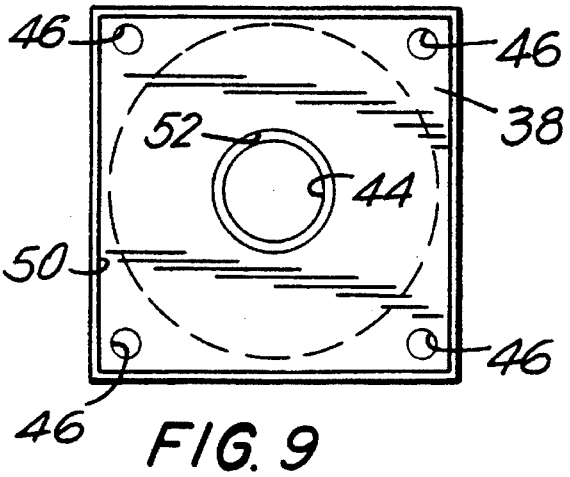
FIG. 9 is a plan view of a larger metal plate shown in FIG. 1.

Synthetic rubber sealer 48 (FIG. 1) passes through the smaller holes 46 shown in FIG. 9. The purpose of these smaller holes 46 is to assist synthetic rubber sealer 48 to hold larger metal plates 38, so as to keep in position multilayered metal plates 34 during reciprocal displacement of bearing unit 14. Notch lines for the outer and inner sides of larger metal plates 38 are depicted in FIG. 9 by means of lines 50 and 52, respectively.

Figure 10:
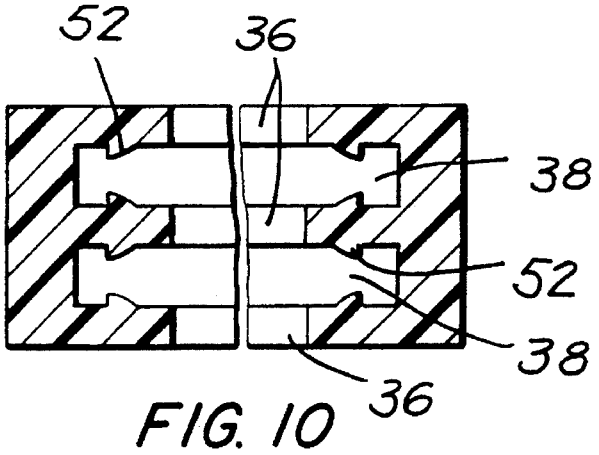
FIG. 10 is the partial view of inner and outer ends of multilayered metal plates indicated in FIG. 1.

FIG. 10 illustrates that the notch lines 50, 52 interlock the synthetic rubber sealer 48 between larger metal plates 38. The surface of smaller metal plates 36 and larger metal plates 38 are coated by a lubricant material in order to reduce friction forces between plates 34, and also to protect direct exposure of metal plates 34 from oxygen in the atmosphere. Anchor bar 42 is located in the center of the structure to limit the displacement of bearing unit 14 in order to protect the superstructure on the bearing unit from sudden collapse without warning.

Anchor bar 42, as mentioned previously has anchor balls 22, at its top and bottom, and with such bars, stands vertically at the center of bearing unit 14. Multilayered metal plates 34 and anchor bar 42 define a gap therebetween that is filled with synthetic rubber 48. Synthetic rubber 48 functions as a filler to cushion the superstructure in order to make anchor bar 42 capable of evenly distributing horizontal force and displacement to metal plates 34, so as to align the horizontal movement of the multilayered metal plates 34. When the bearing unit 14 is suddenly attacked by horizontal impact, such as by seismic forces, bearing unit 14 absorbs the impact, as with a cushion, by horizontal shear displacement of multilayered metal plates 34.

As the multilayered metal plates 34 move horizontally under seismic forces, anchor bar 42 leans down until ball headers 22 at the top and bottom are interlocked in top and bottom guide plates 28.

FIG. 2 illustrates that anchor bar 42 limits shear deformation of bearing unit 14. Bearing unit 14 has a sealed outer face by means of synthetic rubber 48. The top and bottom edges 54 of synthetic rubber filler 48 are closed by V-shaped stiffeners 56, welded to top and bottom cover plates 18 in order that water may not infiltrate into the bearing unit 14.

Figure 3:
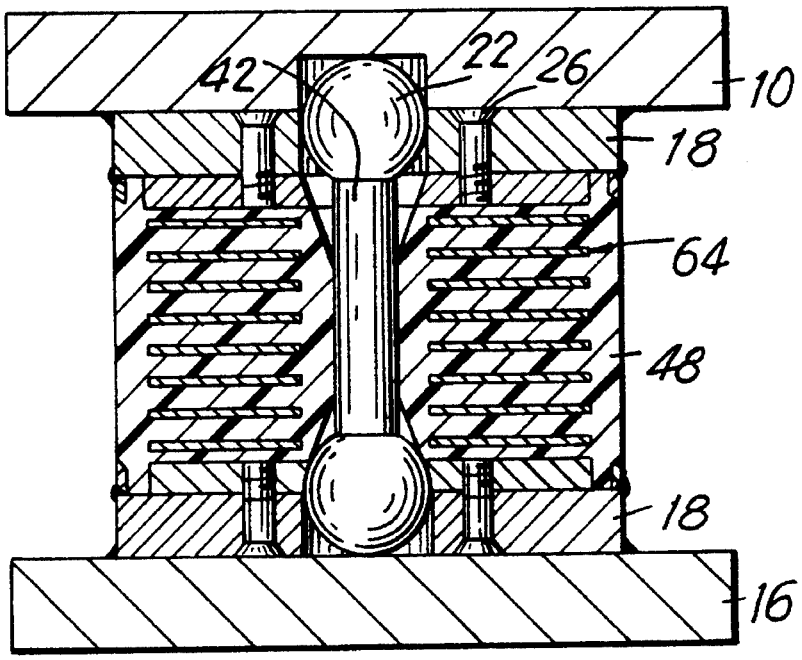
FIG. 3 is a sectional view of a synthetic rubber bearing reinforced with metal plates, which utilizes a vertical anchor bar of the present invention.

FIG. 3 illustrates that anchor bar 42 is utilized in synthetic rubber bearings reinforced by multilayered metal plates 64.

Figure 4:
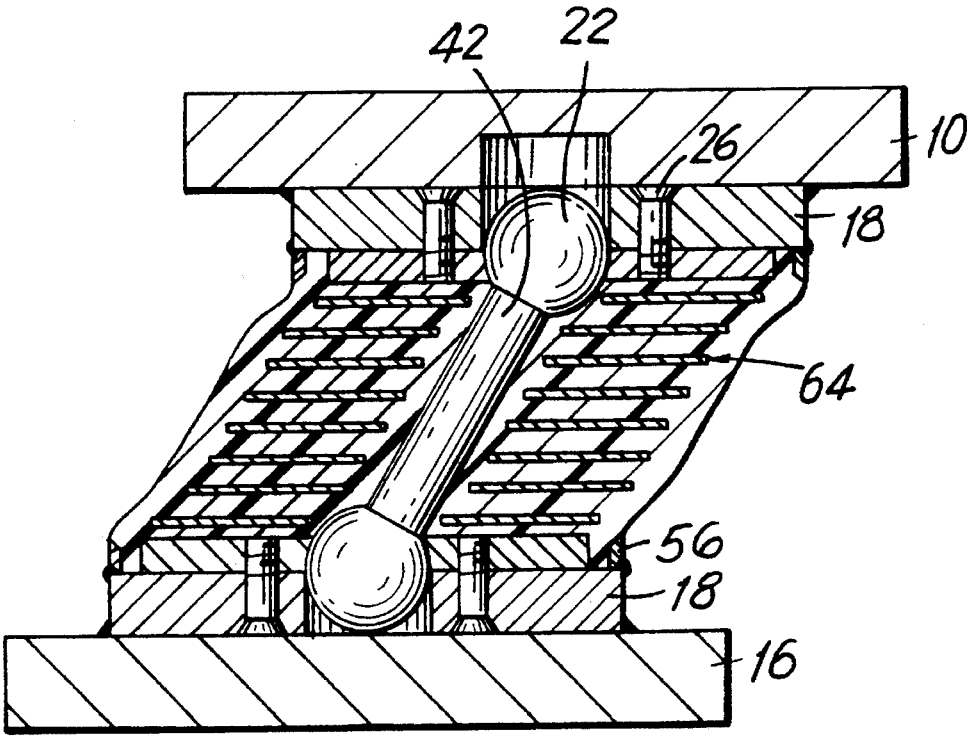
FIG. 4 is a sectional view in deformed shape of the synthetic rubber bearing shown in FIG. 3.

Anchor bar functions to restrict horizontal movement of the bearing unit shown in FIG. 4, as it does in the present invention as shown in FIG. 2.

As discussed above, the present invention is proposed to resist more efficiently against seismic reciprocal forces.

What is claimed is:

1. A bearing structure having a bearing unit with top and bottom portions for use in supporting another structure, comprising a bearing unit including a plurality of metal plates, a synthetic rubber element for covering said bearing unit and an anchor bar extending from the top portion of said bearing unit to the bottom portion thereof and defining with said metal plates a space for said synthetic rubber, said bearing structure further comprising anchor balls with said anchor bar extending between said anchor balls, and said bearing unit further including cover plates and guide plates proximate its top and bottom portions, each of said cover plates, and each of said guide plates, defining at its center portion a pocket for said anchor balls, said anchor bar and balls for restricting horizontal displacement.

2. The invention according to claim 1, wherein said metal plates include larger metal plates and smaller metal plates, arranged alternately, overlaying and in contact with each other.

3. The invention according to claim 2, wherein said smaller plates and said larger plates define central openings through which said anchor bar passes.

4. The invention according to claim 2, wherein said smaller plates are round in shape and said larger plates are square in shape.

* * * * *